US007431392B2

(12) United States Patent
Tamara

(10) Patent No.: US 7,431,392 B2
(45) Date of Patent: Oct. 7, 2008

(54) CHAIR HAVING BUILT-IN AUDIO SPEAKERS AND A SLIDE-OUT COMPARTMENT FOR A PORTABLE DIGITAL STORAGE AND PLAYBACK DEVICE

(75) Inventor: George Tamara, Glendale, CA (US)

(73) Assignee: True Seating Concepts, LLC (MU)

( * ) Notice: Subject to any disclaimer, the term of this patent is extended or adjusted under 35 U.S.C. 154(b) by 0 days.

(21) Appl. No.: 11/527,942

(22) Filed: Sep. 26, 2006

(65) Prior Publication Data

US 2008/0073953 A1 Mar. 27, 2008

(51) Int. Cl.
*A47C 7/62* (2006.01)

(52) U.S. Cl. ..... 297/217.4

(58) Field of Classification Search ..... 297/217.4, 297/217.3

See application file for complete search history.

(56) References Cited

U.S. PATENT DOCUMENTS 1,318,403 A * 10/1919 Peavy ..... 297/217.4
1,700,337 A * 1/1929 Renner ..... 297/188.19
2,879,835 A * 3/1959 Miller ..... 297/217.4
4,868,888 A * 9/1989 Dayton ..... 455/575.1
4,979,777 A * 12/1990 Takada ..... 297/250.1
5,316,369 A * 5/1994 Kanda ..... 297/188.15
5,318,340 A * 6/1994 Henry ..... 297/232
5,482,352 A * 1/1996 Leal et al. ..... 297/217.4
5,490,711 A * 2/1996 Pollock ..... 297/186
5,624,156 A * 4/1997 Leal et al. ..... 297/217.4
5,838,808 A * 11/1998 Prosser ..... 381/388
6,102,476 A * 8/2000 May et al. ..... 297/217.3
6,523,894 B1 * 2/2003 Mellace ..... 297/217.4
6,814,709 B2 * 11/2004 Schwartz et al. ..... 601/57
6,899,390 B2 * 5/2005 Sanfrod et al. ..... 297/217.4
2004/0021351 A1 * 2/2004 House ..... 297/217.4

* cited by examiner

*Primary Examiner*—Milton Nelson, Jr.
(74) *Attorney, Agent, or Firm*—Morland C. Fischer

(57) ABSTRACT

A chair for the home or office having a seat, a back rest and a pair of tubular chair arms at opposite sides of the seat to support respective arm rests. A slide-out compartment is built into the arm rest of one of the pair of chair arms. The slide-out compartment is sized to accommodate therewithin an I-Pod device, an Mp3 player, or a similar digital storage and playback device. An audio speaker is built into each of the chair arms above the seat. An electrical connector is located in the slide-out compartment to be mated to either one of the I-Pod device or Mp3 player so that the stored content thereof can be supplied to the speakers. The chair is wired so as to enable the chair occupant to power his I-Pod device from a DC voltage source, to listen to the audio (e.g., music) output of the I-Pod device or Mp3 player at the audio speakers, and to control the sound that is emitted by the speakers.

16 Claims, 5 Drawing Sheets

CHAIR HAVING BUILT-IN AUDIO SPEAKERS AND A SLIDE-OUT COMPARTMENT FOR A PORTABLE DIGITAL STORAGE AND PLAYBACK DEVICE

BACKGROUND OF THE INVENTION

1. Field of the Invention

This invention relates to a chair having a slide-out compartment built into one arm thereof in which to receive a portable digital storage and playback device such as, for example, an I-Pod device or an Mp3 player. The chair also has a built-in audio speaker carried by each arm from which an occupant of the chair can enjoy the audio (e.g., musical) content of the storage and playback device within his own personal comfort zone and listening environment.

2. Background Art

An I-Pod device and an Mp3 player are well-known portable devices which are adapted to store digital content for playback. Such digital content typically takes the form of music or similar audio. The user may simply listen to the stored digital content as it is emitted by the storage and playback device or use an earpiece to listen to the content in private.

Should the occupant wish to rest or nap on a chair, he may listen to the audio content by placing the storage and playback device in his pocket, on his lap, or on an arm of the chair. However, the occupant may simply forget to carry the storage and playback device with him. In this case, there will be no source of audio (e.g., music) content for the occupant to enjoy while seated on the chair. Should the occupant remember to carry the storage and playback device with him, he may still have to frequently reach for and manipulate the device in order to turn the device on and off and to control the volume of the audio content emitted therefrom. Moreover, if it had already been in use for a long time, the storage and playback device may ultimately lose power so as to be disabled altogether.

What would be desirable is a chair having a built-in compartment within which a portable digital storage and playback device can be located and powered and a pair of built-in speakers to be coupled to the storage and playback device so that the occupant of the chair can enjoy and control the audio output of the device within a personal comfort zone and listening environment and without having to exert himself to locate and manipulate the device.

SUMMARY OF THE INVENTION

In general terms, a home or office chair is disclosed having a seat supported from a chair base, a pair of chair arm rests at opposite sides of the seat, and a back rest. An audio speaker is held adjacent each side of the seat by first and second pairs of hollow arm rest support tubes that support respective ones of the arm rests. Built into one of the arm rests is a slide-out compartment that can be pulled outwardly from the arm rest to an open position or pushed inwardly thereof to a closed position. The slide-out compartment is sized to accommodate therewithin either one of a well known I-Pod device, Mp3 player, or similar portable digital storage and playback device.

First and second electrical connectors are available at the slide-out compartment. A first connector is adapted to be mated to the I-Pod device. In this case, the I-Pod device can be powered by a source of DC voltage from a battery pack or from the output of an AC/DC voltage converter. In addition, the battery pack can be recharged by the AC/DC voltage converter. At the same time, the audio output of the I-Pod device will be emitted by the audio speakers at opposite sides of the seat so as to be heard by the occupant of the chair. The second connector is adapted to be mated to the Mp3 player. In this case, the audio output of the Mp3 player will be emitted by the audio speakers so as to be heard by the chair occupant. Light emitting diodes located in the pair of chair arm rests will flash when sound is emitted by the speakers.

Located at the other chair arm rest are a series of control switches. A master power switch controls power to the I-Pod device located within the slide-out compartment. Audio control (mute) and volume switches determine whether the audio content of the I-Pod device or Mp3 player will be emitted by the audio speakers or by a set of optional headphones connected to the I-Pod device.

DESCRIPTION OF THE PREFERRED EMBODIMENT

Figure 1:
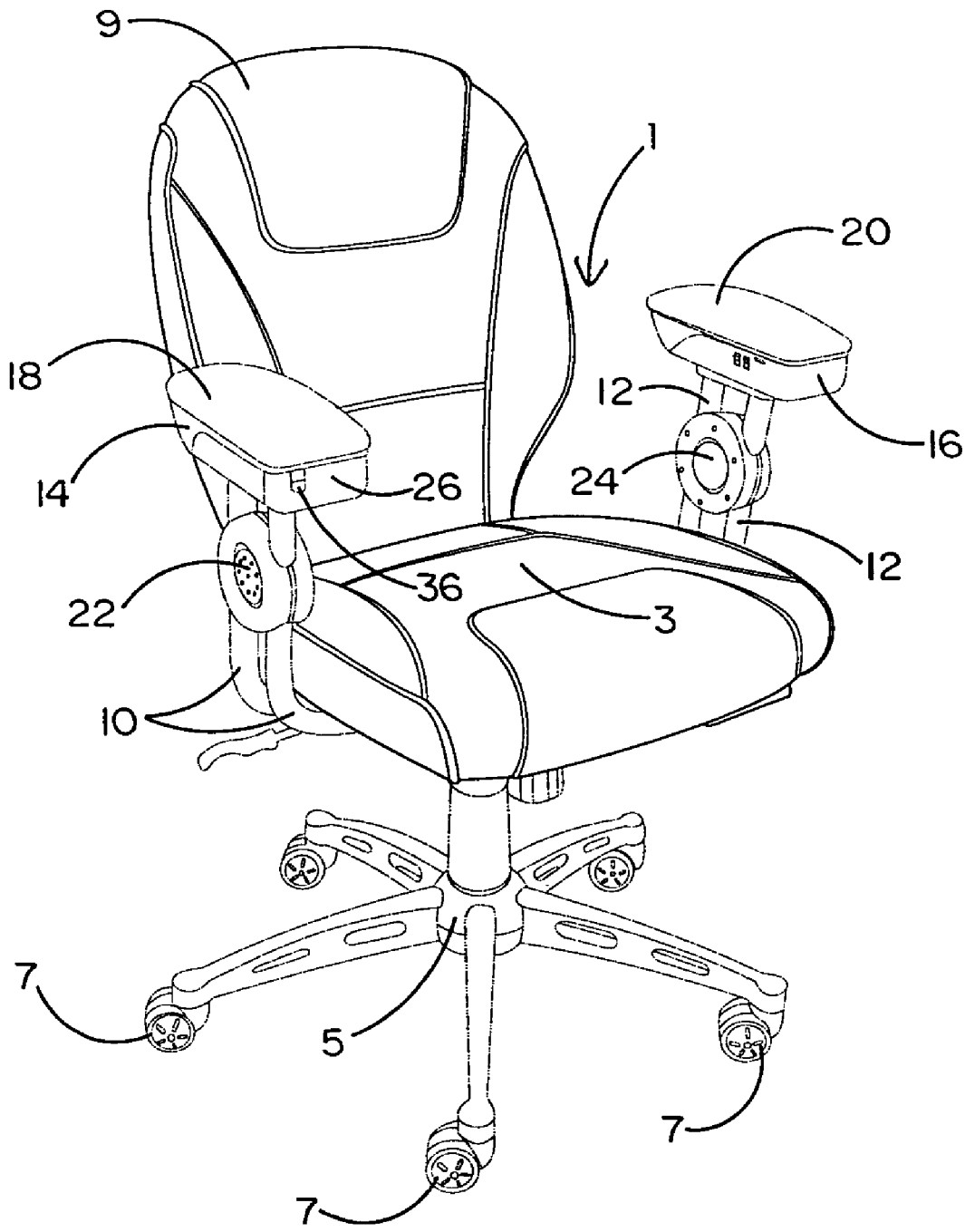
FIG. 1 illustrates a home or office chair according to a preferred embodiment of the present invention having a slide-out compartment for receiving a portable digital storage and playback device and a pair of built-in audio speakers to be coupled to the storage and playback device to create a personal comfort zone and listening environment.

Referring initially to FIG. 1 of the drawings, the preferred embodiment for a chair 1 is illustrated which forms the present invention and which creates a personal comfort zone and listening environment for the chair occupant. As will be disclosed in greater detail hereinafter, the chair 1 is suitable for use in the home or office but has several unique features by which it can be distinguished from a typical home or office chair. In particular, the chair 1 is wired (best shown in FIG. 5) for connection to a commercially-available portable digital storage and playback device, such as that commonly known as an I-Pod device or an Mp3 player. To this end, one arm rest of the chair 1 has a built-in, slide-out compartment 26 which is adapted to accommodate the portable digital storage and playback device at an innocuous location so as to remain out of sight and ready for use. In this same regard, the chair 1 carries a pair of built-in audio speakers 22 and 24 at opposite sides thereof to be interconnected to the digital storage and playback device so that one seated in the chair can listen to the audio output (e.g., music) of the storage and playback device.

The chair illustrated in FIG. 1 has other features which are common to the usual home or office chair. For example, the chair 1 includes a seat 3 to support the weight of the occupant. The seat 3 is mounted on a base 5 having rollers or castors 7 to enable the chair to be moved from place to place. A back rest 9 extends upwardly from the seat 3 to support the back of the occupant.

The chair 1 includes pairs 10 and 12 of spaced, parallel-aligned arm rest support tubes that are located at each side of the seat 3. Each pair 10 and 12 of arm rest support tubes is connected between the bottom of the seat 3 by means of a mounting plate (designated 34 in FIGS. 2A and 2B) and a respective arm rest 14 and 16 so that such arm rests are suspended above the seat 3. Cushioned arm pads 18 and 20 are affixed atop respective ones of the arm rests 14 and 16 to give one seated in the chair 1 a place to conveniently rest his arms. Each of the arm rest support tubes 10 and 12 is preferably hollow for an important purpose that will be explained when referring to FIG. 5. Each pair 10 and 12 of arm rest support tubes also holds a respective audio speaker 22 and 24 at one side of the seat 3 so as to lie in close proximity to the occupant. By way of example only, each speaker 22 and 24 is a four watt, eight ohm, two inch diameter audio emitting device.

Figure 2A:
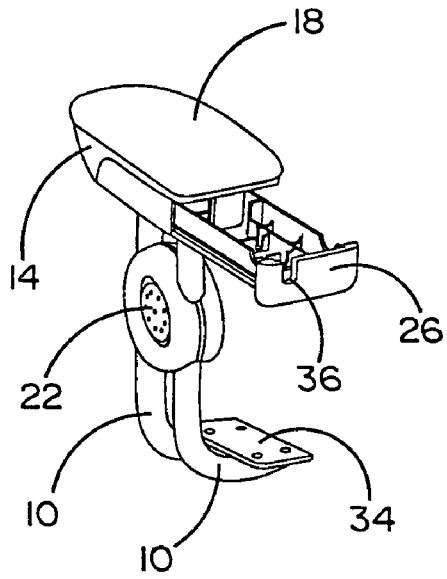
FIG. 2A is a perspective view showing the slide-out compartment carried by one arm of the chair of FIG. 1 and pulled outwardly therefrom to an open position.
Figure 2B:
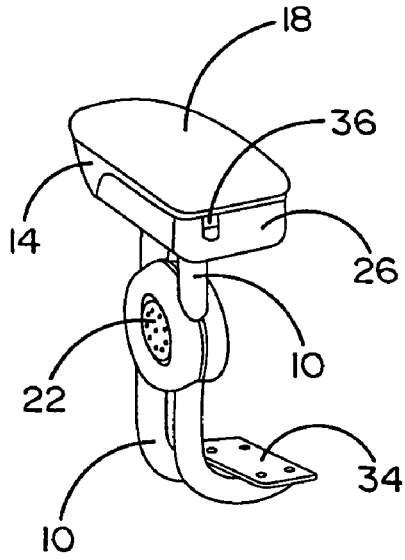
FIG. 2B shows the slide-out compartment pushed inwardly with respect to the chair arm to a closed position.
Figure 3:
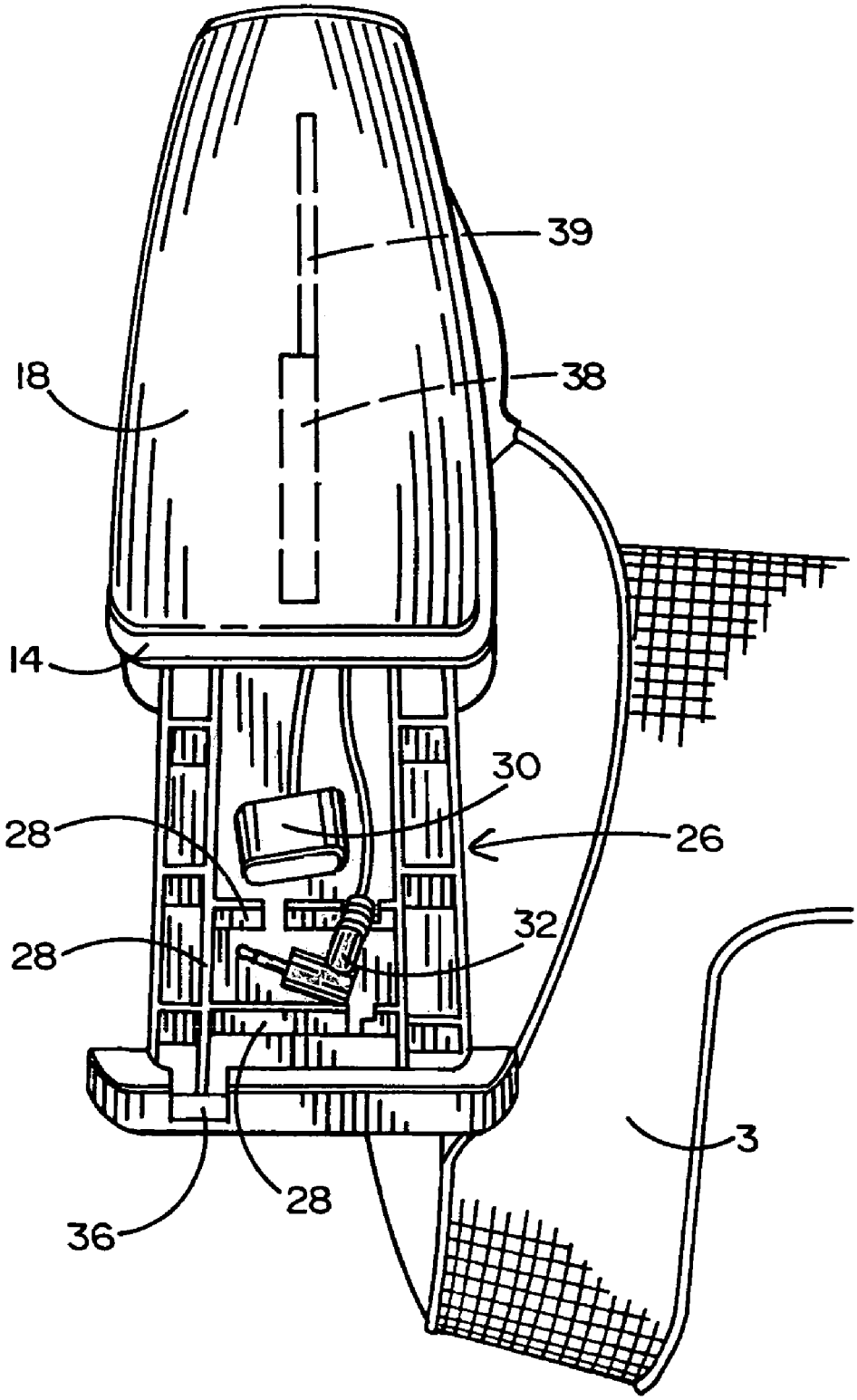
FIG. 3 shows first and second electrical connectors within chambers of the slide-out compartment to be mated to an I-Pod device and an Mp3 player, respectively.

As an important feature of the chair 1, the slide-out compartment 26 is built into one of the pair of arm rests 14 at one side of the seat 3 below arm pad 18. The slide-out compartment 26 is sized to accommodate therewith either an I-Pod device (designated 50 in FIG. 5) or an Mp3 player (designated 52), or a similar portable digital storage and playback device. FIG. 1 shows the slide-out compartment. 26 in a closed (i.e., pushed in) position relative to arm rest 14. Referring in this same regard to FIGS. 2A, 2B and 3 of the drawings, the slide-out compartment 26 is shown in FIG. 2A in an open (i.e., pulled out) position with respect to arm rest 14. In the aforementioned closed position best shown in FIG. 2B, the slide-out compartment 26 is slidably received inwardly of the arm rest 14 so as to enclose and hide the digital storage and playback device from view. In the open position of FIGS. 2A and 3, the slide-out compartment 26 is pulled outwardly from arm rest 14 so as to enable access to an I-Pod device or Mp3 player located therein.

As is best shown in FIG. 3, the slide-out compartment 26 has a series of walls or partitions 28 by which to create separate chambers for receiving a pair of electrical connectors 30 and 32. Connector 30 is a proprietary thirty pin connector of the kind having particular application to be mated to the I-Pod device (50 of FIG. 5). Provided that the occupant of the chair 1 locates such an I-Pod device within compartment 26 to be mated to connector 30 and as will be explained while referring to FIG. 5, a DC voltage will be available to power the device so that the audio output thereof can be supplied to the speakers 22 and 24 (of FIG. 1) to enable the chair occupant to enjoy the music and/or other content that is stored on the device.

The connector 32 available within slide-out compartment 26 is a conventional plug-in jack. In the event that an Mp3 player (52 of FIG. 5) or a similar digital storage and playback device is used in place of the aforementioned I-Pod device 50, the plug-in jack connector 32 can be connected to the usual headphone input terminal of the player. As will also be explained when referring to FIG. 5, the audio output of the Mp3 player 52 in this case is supplied to the music or other audio speakers 22 and 24 (of FIG. 1) so that the occupant of the chair 1 can enjoy the audio content that is stored on his player. However, unlike the I-Pod device 50 that is mated to the proprietary I-Pod connector 30, the Mp3 player 52 that is mated to the jack connector 32 will not receive a DC voltage to be powered thereby.

An open window or cutout 36 is formed in the front of the slide-out compartment 26 to which a pulling or pushing force is applied in order to cause compartment 26 to slide between the previously-described open and closed positions (of FIGS. 2A and 2B) with respect to the arm rest 14. In the event that an I-Pod device 50 is located within the compartment 26 and mated to the proprietary I-Pod connector 30, the window 36 will be automatically aligned with the existing headphone input terminal of the I-Pod device to allow a quick and convenient connection via window 36 between I-Pod device 50 and a set of optional headphones should the occupant wish to listen to the stored audio content through the privacy of his headphones.

To enhance the appeal of the chair 1, each of the opposing arm rests 14 and 16 may be manufactured from a translucent plastic material. A light emitting diode (LED) 38 (best shown in FIG. 3) is located inwardly of each of the arm rests 14 and 16 below the respective arm pads 18 and 20. As will be explained when referring to FIG. 5, the LEDs 38 are pulsed in synchronization with the audio output of the I-Pod device 50 or the Mp3 player 52 so that flashing lights will be visible through the arm rests 14 and 16 in time with the music. That is, electrical wires 39 run through the arm rests 14 and 16 so that the LEDs 38 can receive DC power.

Figure 4:
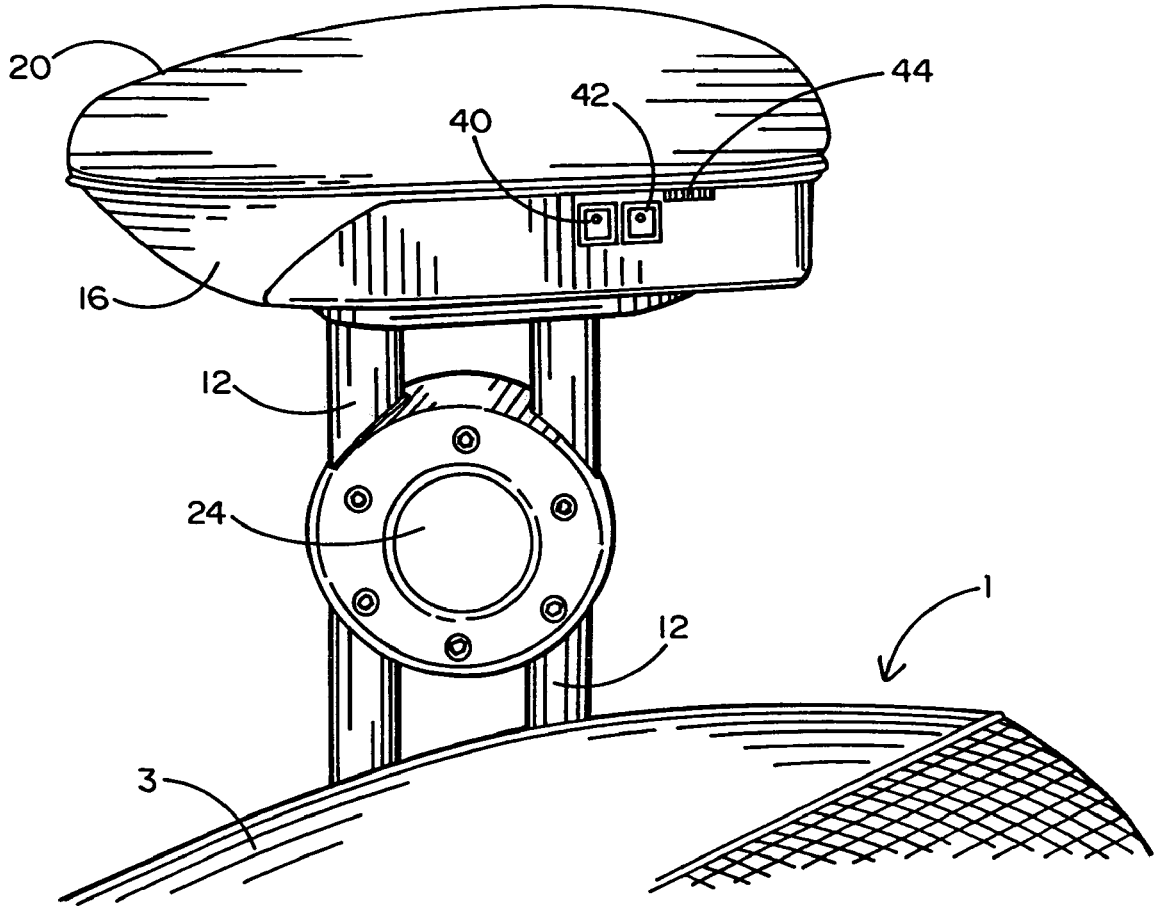
FIG. 4 shows a series of audio control switches mounted at the opposite arm of the chair of FIG. 1 so as to be easily accessible to the chair occupant.

Referring concurrently to FIGS. 1 and 4 of the drawings, details are shown of the arm rest 16 and the arm pad 20 that are located at one side of the seat 3 of the chair 1 opposite the arm rest 14 and arm pad 18 having the built-in compartment 26 (of FIG. 3). Mounted in the arm rest 16 are a pair of electrical (e.g., rocker) switches 40 and 42 that are disposed within easy reach of the chair occupant. A first of the switches 40 is a master power switch. Master power switch 40 controls the supply of DC power to the I-Pod device 50 (of FIG. 5) within slide-out compartment 26. When the master power switch 40 is moved to an on position, a DC voltage is supplied to the I-Pod device 50 and the audio speakers 24 and 26 are energized such that sound is emitted therefrom. With power switch 40 in the off position, no power is supplied to device 50 or player 52 and speakers 24 and 26 are disabled.

The other switch 42 is an audio control switch. When the audio control switch 42 is moved to an off position, sound will be simultaneously emitted from the audio speakers 24 and 26 as well as from a set of optional headphones. When audio control switch 42 is moved to an on or mute position, the audio speakers 24 and 26 will be disabled and emit no sound. In this case, all of the sound generated by the I-Pod device 50 will be emitted entirely by any headphones that are worn by the chair occupant.

Where an Mp3 player 52 (of FIG. 5) is otherwise located within the slide-out storage compartment 26, movement of the master power switch 40 between the on and off positions determines whether the audio output of the player 52 will be heard from audio speakers 24 and 26 (with switch 40 in the on position) or not heard at all (with switch 40 in the off position).

Also mounted within the arm rest 16 adjacent the power and audio control switches 40 and 42 is a volume (i.e., dial) switch 44. The volume dial 44 is rotated by the chair occupant to either raise (i.e., amplify) or lower (depending upon the direction of rotation) the volume of the sound that is emitted by the audio speakers 22 and 24 and/or any headphones worn by the chair occupant.

Figure 5:
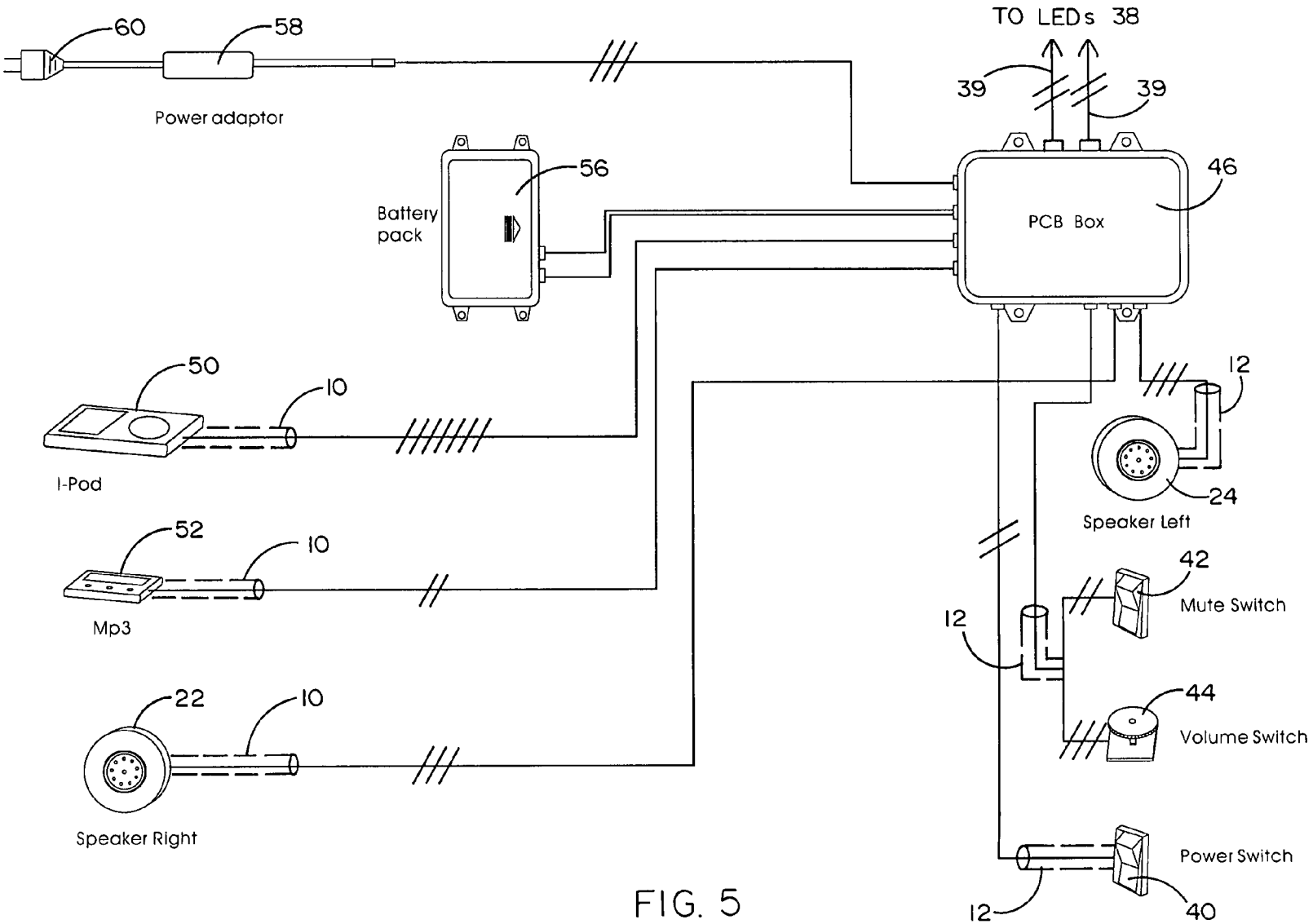
FIG. 5 shows an electrical wiring diagram that is illustrative of an audio control system for the chair of FIG. 1 by which the storage and playback device is interconnected to the audio speakers and audio control switches.

FIG. 5 of the drawings shows a wiring diagram that is illustrative of an audio control system by which to enable the occupant of the chair 1 (of FIG. 1) to power his I-Pod device 50, to listen to the stored audio content of his I-Pod device 50 or Mp3 player 52, and to control the sound that is emitted by the audio speakers 22 and 24 that are supported at opposite sides of the chair seat 3 (of FIG. 1). Routing of electrical signals between device 50 and player 52, speakers 22 and 24, and control switches 40, 42 and 44 is regulated by an integrated circuit that is mounted on a printed circuit board (not shown) enclosed by a fluid and dust-tight signal routing PCB box 46 that is preferably secured under the seat 3 of chair 1. Suitable integrated circuits that are capable of routing the electrical signals throughout the audio control system of FIG. 5 are known to those skilled in the art and do not form a part of the present invention.

A 12 volt battery pack 56 is also preferably secured under the seat 3 of the chair 1. It is contemplated that battery pack 56 will contain eight 1.5 volt AA batteries. The batteries within pack 56 may be rechargeable to avoid the inconvenience of having to be replaced when drained of energy. In addition, an AC/DC power adapter 58 is secured below the seat 3 of chair 1. The AC/DC power adapter 58 can be connected to an available source of 110 volt AC power (such as that available from a standard electrical wall receptacle) by way of an electrical plug 60 so as to provide a 12 volt DC output to power I-Pod device 50 and recharge the batteries of battery pack 56. Each of the battery pack 56 and power adapter 58 is electrically connected by means of electrical wires to the PCB signal routing box 46. In the case where the batteries are rechargeable, an additional wire is included by which to connect the PCB box 46 back to the battery pack 56 so that the batteries within the pack may be recharged (by way of plug 60 and power adapter 58) and reused rather than replaced and discarded.

As previously described, in the event that an I-Pod device 50 is located in the slide-out compartment 26 (of FIG. 3) to be mated to the proprietary I-Pod connector 30 therewithin, the device 50 will be powered by a DC voltage available from either the battery pack 56 or from the output of the AC/DC power adapter 58. To this end, the I-Pod device 50 is connected by means of electrical wires to the PCB signal routing box 46 to receive a DC voltage from one of the battery pack 56 or power adapter 58 depending upon whether plug 60 is connected to a suitable AC voltage source. At the same time, the stored audio output of the I-Pod device 50 can be supplied to the pair of audio speakers 22 and 24 by way of PCB box 46.

On the other hand, and as was also described, in the event that an Mp3 player 52, rather than I-Pod device 50, is located in the slide-out compartment 26 (of FIG. 3) to be mated to the plug-in jack 32, the player 52 will receive none of the available DC power. In this case, the Mp3 player 52 is connected by means of electrical wires to the PCB signal routing box 46 so that the stored audio output of player 52 can be supplied to the pair of audio speakers 22 and 24.

Each of the (right and left side) audio speakers 22 and 24 being supported by pairs 10 and 12 of arm rest support tubes at opposite sides of the chair 1 (of FIG. 1) is connected by means of electrical wires to the PCB signal routing box 46 so that the stored audio content of I-Pod device 50 and Mp3 player 52 can be heard at speakers 22 and 24. Likewise, each of the LEDs (e.g., designated 38 in FIG. 3) is connected by electrical wires 39 to PCB box 46 so that the LEDs can be fired on time.

Power switch 40 is connected to the PCB signal routing box 46 by means of electrical wires. The audio control (mute) switch 42 and the volume dial switch 44 are also connected to PCB signal routing box 46 by which to enable the chair occupant to control the sound that is emitted by the audio speakers 22 and 24.

In particular, the power switch 40, audio control switch 42, and volume dial switch 44 are selectively operated by the occupant of the chair 1, as earlier described, to control the audio output and the loudness of the sound generated by the I-Pod device 50 or Mp3 player 52 and emitted by the audio speakers 22 and 24 (or the optional set of headphones). In any event, the chair occupant will be able to easily manage the audio output of his I-Pod device 50 or Mp3 player 52 with a single hand and without having to leave his personal comfort zone and listening environment or open the slide-out compartment 26 (of FIG. 3) so that the chair occupant can choose to listen to the stored audio content of device 50 and player 52 through speakers 22 and 24 or (in the case of I-Pod device 50) in privacy through his headphones.

To enhance the aesthetic appearance of the chair 1 and to prevent a possible break in one of the wires illustrated in FIG. 5, such wires run through and are shielded by the pairs 10 and 12 of hollow arm rest support tubes which hold the audio speakers 22 and 24 above the seat 3. By way of example, the wires from the electrical connectors (designated 30 and 32 in FIG. 3) for the I-Pod device 50 and Mp3 player 52 and the right side speaker 22 will run through one pair 10 of hollow tubes at the right side of the chair 1. In this same regard, the wires from the audio control switches 40, 42 and 44 and the left side speaker 24 will run through the other pair 12 of hollow tubes at the left side of the chair 1. By virtue of the foregoing, there is less likelihood that the audio control system of chair 1 will suffer a malfunction as a consequence of an open electrical circuit.

The invention claimed is:

1. A chair having a seat to support an occupant and a pair of chair arms located at opposite sides of the seat, said chair comprising:

a compartment in which to receive an audio storage and playback device, said compartment located inside a first of said pair of chair arms and having an electrical connector to be mated to the audio storage and playback device to be received therein, said compartment being slidable inwardly and outwardly between closed and open positions with respect to said first chair arm;

at least a first audio speaker to emit the audio content of the audio storage and playback device, said first audio speaker being located at one of said pair of chair arms at one side of said seat; and an audio control system by which said first audio speaker is electrically connected to said electrical connector of said compartment in which the audio storage and playback device is received.

2. The chair recited in claim 1, said audio control system including an electrical switch to control the connection of said electrical connector within said compartment to said first audio speaker, said electrical switch being located and accessible to the chair occupant at the second of said pair of chair arms.

3. The chair recited in claim 1, wherein said chair also comprises a second audio speaker, each of said first and second audio speakers electrically connected to the electrical connector of said compartment by means of said audio control system, and each of said first and second audio speakers being affixed to and held above the seat by a respective one of said pair of chair arms at opposite sides of said chair seat.

4. The chair recited in claim 1, wherein the one of said pair of chair arms at which said first audio speaker is located is hollow, said audio control system including electrical wires that run through said hollow chair arm between the electrical connector of said compartment and said first audio speaker located at said hollow chair arm.

5. The chair recited in claim 1, wherein each of the pair of chair arms includes an arm rest to support the arms of the chair occupant, said compartment in which to receive the audio storage and playback device being located within the arm rest of the first of said pair of chair arms.

6. The chair recited in claim 5, wherein the said arm rest of said first chair arm having said slidable compartment is manufactured from an optically transparent material, said chair further comprising a light emitting diode disposed within said optically transparent arm rest, said light emitting diode caused to flash within said arm rest when the audio content of the storage and playback device is emitted by said first audio speaker such that the flash from said light emitting diode is visible through said arm rest.

7. The chair recited in claim 1, said audio control system including a source of battery voltage coupled to the electrical connector within said compartment in which to receive the audio storage and playback device from which the storage and playback device can be powered.

8. The chair recited in claim 7, said audio control system also including an AC/DC voltage adapter to be connected to a source of AC voltage, said AC/DC voltage adapter coupled to said electrical connector within said compartment in which to receive the audio storage and playback device to provide a DC output voltage from which the storage and playback device can be powered and said source of battery voltage recharged.

9. A chair having a seat to support an occupant and a pair of chair arms located at opposite sides of the seat, said chair comprising:

a compartment in which to receive a removable audio storage and playback device, said compartment having an electrical connector to be detachably connected to the removable audio storage and playback device received therein, and said compartment having closed and open positions, said compartment being in the open position at which said electrical connector is adapted to be detachably connected to and disconnected from the audio storage and playback device;

at least a first audio speaker to emit the audio content of the audio storage and playback device; and an audio control system by which said first audio speaker is electrically connected to said electrical connector of said compartment in which the audio storage and playback device is to be received, said audio control system including a source of battery voltage coupled to the electrical connector within said compartment in which the removable audio storage and playback device is to be received so that the storage and playback device is powered by said source of battery voltage, said audio control system also including an AC/DC voltage adapter to be connected to a source of AC voltage, said AC/DC voltage adapter coupled to said electrical connector within said compartment in which the removable audio storage and playback device is to be received so that a DC output voltage is provided by said AC/DC voltage adapter from which the storage and playback device is powered and said source of battery voltage is recharged.

10. The chair recited in claim 9, wherein said chair also comprises a second audio speaker, each of said first and second audio speakers electrically connected to the electrical connector of said compartment by means of said audio control system, and each of said first and second audio speakers being located at respective ones of said pair of chair arms at opposite sides of said chair seat.

11. The chair recited in claim 10, wherein each of said pair of chair arms is hollow, said audio control system including electrical wires that run through said hollow chair arms between said first and second audio speakers and said electrical connector.

12. The chair recited in claim 9, wherein said first audio speaker is located at one of said pair of chair arms at one side of said seat.

13. The chair recited in claim 9, wherein said compartment in which to receive the removable audio storage and playback device is located at one of said pair of chair arms at one side of said seat, said compartment being slidable inwardly and outwardly relative to said one chair arm between said closed and open positions.

14. The chair recited in claim 13, wherein the said one of said pair of chair arms includes an arm rest to support an arm of the chair occupant, said compartment in which to receive the removable audio storage and playback device being located within and slidable between said closed and open positions with respect to said arm rest.

15. The chair recited in claim 14, wherein the arm rest of the said one chair arm having said slidable compartment is manufactured from an optically transparent material, said chair further comprising a light emitting diode disposed within said optically transparent arm rest, said light emitting diode caused to flash within said arm rest when the audio content of the removable audio storage and playback device is emitted by said first audio speaker such that the flash from said light emitting diode is visible through said arm rest.

16. The chair recited in claim 9, said audio control system including an electrical switch to control the connection of said electrical connector within said compartment to said first audio speaker, said electrical switch being located on one of said pair of chair arms so as to be accessible to the chair occupant.

* * * * *